US008926158B2

(12) United States Patent
Holman et al.

(10) Patent No.: US 8,926,158 B2
(45) Date of Patent: Jan. 6, 2015

(54) ARRAY ILLUMINATION SYSTEM

(75) Inventors: Robert L. Holman, San Jose, CA (US); Matthew Brian Sampsell, San Jose, CA (US)

(73) Assignee: QUALCOMM MEMS Technologies, Inc., San Diego, CA (US)

( * ) Notice: Subject to any disclaimer, the term of this patent is extended or adjusted under 35 U.S.C. 154(b) by 262 days.

(21) Appl. No.: 13/459,480

(22) Filed: Apr. 30, 2012

(65) Prior Publication Data

US 2013/0286684 A1 Oct. 31, 2013

(51) Int. Cl.
*F21V 7/04* (2006.01)

(52) U.S. Cl.
USPC ..... 362/612; 362/613; 362/615

(58) Field of Classification Search
CPC ..... F21V 17/16; F21K 9/52; F21Y 2102/02
USPC ..... 362/612, 613, 615, 616
See application file for complete search history.

(56) References Cited

U.S. PATENT DOCUMENTS

| | | | |
|---|---|---|---|
| 5,668,913 | A | 9/1997 | Tai et al. |
| 6,044,196 | A | 3/2000 | Winston et al. |
| 7,587,117 | B2 | 9/2009 | Winston et al. |
| 8,348,489 | B2 | 1/2013 | Holman et al. |
| 2002/0114168 | A1 | 8/2002 | Pelka et al. |
| 2002/0149924 | A1 | 10/2002 | Falicoff et al. |
| 2003/0043568 | A1 | 3/2003 | Suzuki et al. |
| 2007/0159846 | A1 | 7/2007 | Nishiyama et al. |
| 2008/0037279 | A1 | 2/2008 | Chan |
| 2010/0315833 | A1 | 12/2010 | Holman et al. |
| 2011/0175533 | A1 | 7/2011 | Holman et al. |
| 2011/0205737 | A1 | 8/2011 | Kong |
| 2011/0222307 | A1 | 9/2011 | Kong |

FOREIGN PATENT DOCUMENTS

| | | | |
|---|---|---|---|
| EP | 1847858 | A1 | 10/2007 |
| EP | 2444722 | A1 | 4/2012 |

OTHER PUBLICATIONS

International Search Report and Written Opinion—PCT/US2013/037841—ISA/EPO—Jul. 25, 2013.

Park J.K., et al., "A Suggestion for High Power LED Package Based on LTCC," Electronic Components and Technology Conference, 2006, pp. 1070-1075.

European Search Report—EP 2247978, European Patent Office, Nov. 28, 2012.

European Communication—EP 2247978, European Patent Office, Oct. 2, 2013.

*Primary Examiner* — Vip Patel

(74) *Attorney, Agent, or Firm* — Knobbe Martens Olson & Bear LLP

(57) ABSTRACT

This disclosure provides systems, methods, and apparatuses for array illumination. In one aspect, an array of light engines is coupled to a support structure. Each light engine can be separately controlled to achieve a desired output beam. In another aspect, a support structure includes an array of LED emitters. The support structure is configured to removably receive a plurality of light guides over the array of LED emitters, thereby forming an array of light engines. The support structure can include an integrated heat sink in thermal communication with the array of LED emitters. Light from the LED emitters is distributed over the surface of the light guides to produce a desired output beam. The light engines can be configured to produce output beams of differing color, direction, shape and/or size.

22 Claims, 10 Drawing Sheets

ARRAY ILLUMINATION SYSTEM

TECHNICAL FIELD

This disclosure relates generally to the field of illumination systems and luminaires, such as for large area lighting or architectural lighting.

DESCRIPTION OF THE RELATED TECHNOLOGY

Many conventional light fixtures used in commercial light applications are large, and heavy. For example, certain commercial light fixtures are too heavy for most ceiling frameworks, and use reinforcement for additional mechanical support. Similarly, many conventional light fixtures are also very thick and thus reduce the effective ceiling height, which can become an issue where ceiling height is limited by structural boundaries in buildings. Many conventional light fixtures also often produce unwanted glare from the fixture's aperture.

Recently, light fixtures utilizing light emitting diodes ("LEDs") are being introduced. However, LEDs are very bright compared to traditional light bulbs and can be hazardous to the eye without additional structures for diffusing the light. One solution is to hide the LEDs from view in the light fixtures, for example, by directing light upwards into wall and ceiling surfaces so that the light reflects from those surfaces. While this approach prevents direct view of the LEDs, the fixtures are still bulky. Another solution involves spreading the LED light over a larger output aperture. However, this approach generally increases the fixture's thickness, and the fixture's off-angle glare.

SUMMARY

The systems, methods and devices of the disclosure each have several innovative aspects, no single one of which is solely responsible for the desirable attributes disclosed herein.

One innovative aspect of the subject matter described in this disclosure can be implemented in an illumination system. The illumination system can include a support structure and a plurality of light engines supported by the support structure. Each light engine can include a light emitting diode (LED) and a light guide optically coupled to the light emitting diode at a first portion. Each light engine can be configured to provide a range of output beam angular distributions. The brightness of each light emitting diode can be distributed over the light guide between the first portion and a second portion.

Another innovative aspect of the subject matter disclosed herein can be implemented in an illumination system including a support structure. The support structure can include a heat sink, a plurality of light emitting diode (LED) emitters, and electrical circuitry electrically connected to the plurality of LED emitters. The support structure can further include a plurality of receptacles configured to removably receive a plurality of light guides thereon.

Another innovative aspect of the subject matter disclosed herein can be implemented in a method of manufacturing an illumination system. The method can include providing a support structure, and mounting a plurality of light engines onto the support structure. Each light engine can include a light emitting diode and a light guide optically coupled to the light emitting diode at a first portion. Each light guide can have a varying thickness that decreases from the first portion to a second portion of the light guide. The brightness of each light emitting diode can be distributed over the light guide between the first and second portions.

Another innovative aspect of the subject matter disclosed herein can be implemented in a method of manufacturing an illumination system. The method can include providing a support structure that includes a heat sink. A plurality of LED emitters can be disposed on the support structure in thermal communication with the heat sink. Electrical circuitry can be provided that is electrically connected to the plurality of LED emitters. A plurality of receptacles can be included in the plurality of LED emitters. The plurality of receptacles can be configured to removably receive a plurality of light guides thereon.

Details of one or more implementations of the subject matter described in this specification are set forth in the accompanying drawings and the description below. Other features, aspects, and advantages will become apparent from the description, the drawings, and the claims. Note that the relative dimensions of the following figures may not be drawn to scale.

BRIEF DESCRIPTION OF THE DRAWINGS

Like reference numbers and designations in the various drawings indicate like elements.

DETAILED DESCRIPTION

Figure 1A:
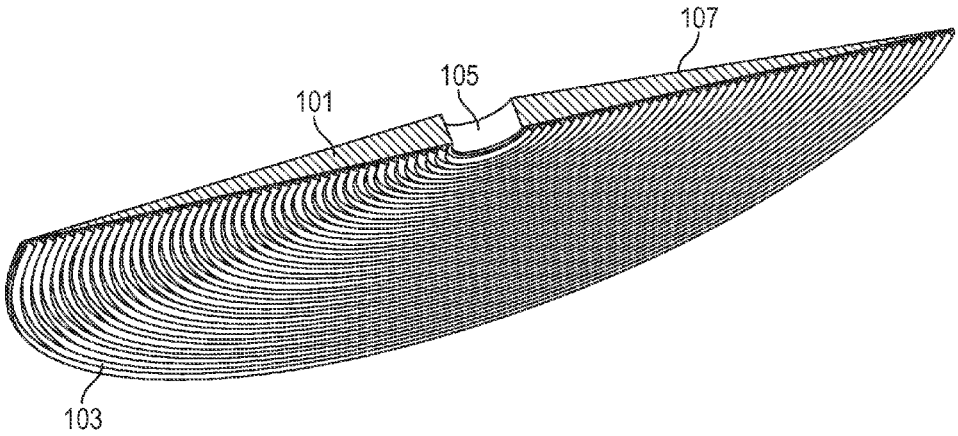
FIG. 1A is a cross-sectional perspective view of an implementation of a circular light guide plate that can be used to receive light from one or more centrally located light emitting diodes (LEDs).

The following description is directed to certain implementations for the purposes of describing the innovative aspects of this disclosure. However, a person having ordinary skill in the art will readily recognize that the teachings herein can be applied in a multitude of different ways. The described implementations may be implemented in any device or system that can be configured to provide illumination. More particularly, it is contemplated that the described implementations may be included in or associated with lighting used for a wide variety of applications such as, but not limited to: commercial and residential lighting. Implementations may include but are not limited to lighting in offices, schools, manufacturing facilities, retail locations, restaurants, clubs, hospitals and clinics, convention centers, hotels, libraries, museums, cultural institutions, government buildings, warehouses, military installations, research facilities, gymnasiums, sports arenas, backlighting for displays, signage, billboards or lighting in other types of environments or applications. In various implementations the lighting may be overhead lighting and may project downward a distance larger (for example, several times or many times larger) than the spatial extent of the lighting fixture. Thus, the teachings are not intended to be limited to the implementations depicted solely in the Figures, but instead have wide applicability as will be readily apparent to one having ordinary skill in the art.

In various implementations described herein, an array of light engines is mounted to a support structure. In various embodiments, light engines can include a light source, or one or more LEDs coupled with optics, or one or more LEDs coupled with optics as well as electrical and heat-management components. Each light engine can include a light emitting diode ("LED") and a light guide optically coupled to the LED. The light guide can have a varying thickness, with the thickest portions nearest the LED, and a gradually decreasing thickness towards the perimeter of the light guide, away from the LED. The brightness of the LED is distributed over the surface area of the light guide. In some implementations, the lumen density of the light engine can be approximately 1000 lumens in a 4-inch diameter, or approximately 0.1 lumens per square millimeter. In some implementations, the lumen density can range from 0.025 to 0.25 lumens per square millimeter. The output aperture of individual light engines can vary. For example, the output aperture can range from about 2.5 inch diameter to about 12 inches in diameter. The dimensions of an array of light engines can vary as well. In some implementations, the array can be between about 8 inches by 8 inches, and about 72 inches by 72 inches. Various other sizes and orientations are possible. For example, the individual light engines need not be circular, and the arrays need not be square, or even rectangular. Depending on the desired illumination, different configurations of individual light engines and of the array can be employed.

In another aspect, a support structure includes a heat sink and a plurality of LED emitters. A plurality of receptacles in the support structure is configured to removably receive a plurality of light guides thereon. Different light guides having different optical properties can be readily attached and detached from the support structure. In some implementations, each light engine is directionally controllable so that beams from the light engines may be directed in various directions. In some implementations, each light engine is separately electrically controllable, such that one light engine may be turned off while others remain illuminated. In some implementations electrical control of the light engines may permit different brightness levels to be set for different light engines via control electronics or dimming switches.

Particular implementations of the subject matter described in this disclosure can be implemented to realize one or more of the following potential advantages. By providing an array of individually controllable light engines, various illumination patterns can be achieved using a single system. Separate control of individual light engines can be employed to improve lighting field efficiency. For example, separate control of the individual light engines can allow for more light towards the desired area, thereby resulting in more efficient use of the emitted light. In some implementations, a user may readily switch out different light engines for different applications, tailoring the characteristics of the emitted light to achieve the desired lighting scheme. Because superior control is enabled over the distribution and direction of light from a light fixture, illumination efficiency for overhead lighting can thereby be improved. Additionally, aesthetic advantages are provided by the ability to array a plurality of thin light engines over a large area and in different configurations, including various shapes and pattern.

FIG. 1A is a cross-sectional perspective view of an implementation of a circular light guide 100. The circular light guide plate 101 has arranged over its rearward surface a faceted light-turning film 103. The thickness of the light guide plate 101 may decrease from the center towards the perimeter, creating a tapered profile. The light guide plate 101 also includes a central cylindrical surface 105 through which light can be injected into the light guide plate 101. Light entering the central boundary 105 propagates radially through the body of the light guide plate 101 by total internal reflection. In implementations where the light guide plate 101 is tapered, light guided in the light guide plate 101 will propagate by total internal reflection until it is ejected by the tapered light guide plate 101 at an oblique angle relative to the rearward surface 106 and/or the light guide plate 101. The obliquely ejected light can optionally interact with the light-turning film 103. In some implementations, the light ejected by the tapered light guide plate 101 can be a narrow beam having an angular width related to the taper angle of the tapered plate 101. In some implementations, light-turning film 103 can turn the light so that center of the output beam is substantially normal to the rearward surface 106, the forward surface 107, and/or the light guide plate 101. Alternatively, the light-turning film 103 can be configured to turn the light so that the center of the output beam is at any angle relative to the forward surface 107. In the some implementation illustrated in FIGS. 1A through 1C, the light-turning film 103 has a metalized surface so as to reflect light emitted from the light guide plate 101 such that the light is turned and output from through light guide plate 101 and emitted from the forward surface 107.

Figure 1B:
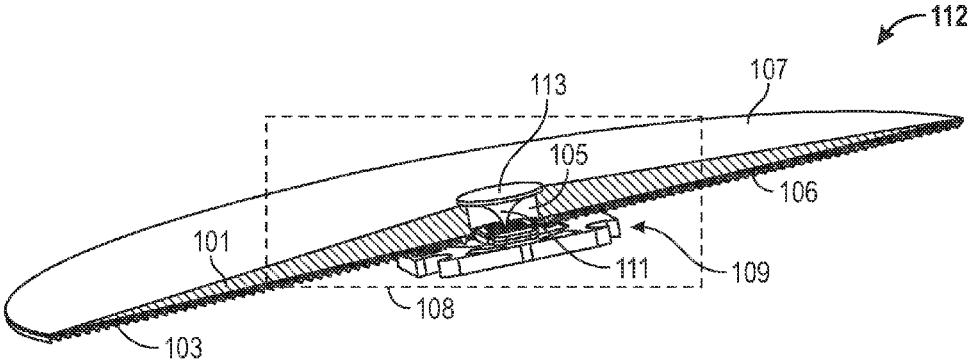
FIGS. 1B and 1C illustrate cross-sectional perspective views of an implementation of a light engine including the circular light guide plate of FIG. 1A.
Figure 1C:
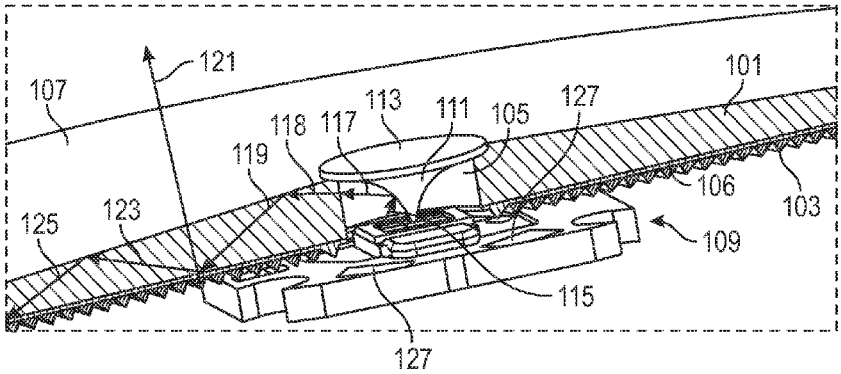

FIGS. 1B and 1C illustrate cross-sectional perspective views of an implementation of an LED emitter combined with the circular light guide plate 101 of FIG. 1A. FIG. 1C shows a magnified view 108 of the cross-section of FIG. 1B. As illustrated, an LED emitter assembly 109 and a radially symmetric reflector 111 are combined with the light guide plate 101 shown in FIG. 1A. Together this structure constitutes a light engine 112. The light emitter assembly 109 may include one or more light emitters such as light emitting diodes. Light emitted from LED emitter assembly 109 reflects off the curved surface 111 of a radially symmetric reflector 113. In some implementations (not illustrated), an etendue-preserving reflector may be used to couple light from the LED emitter assembly 109 to the light guide plate 101. In some embodiments, the radially symmetric reflector 111 can be replaced with a plurality of LEDs oriented to emit light laterally into the light guide plate 101. Light entering the light guide plate 101 propagates therein by total internal reflection between rearward surface 106 and forward surface 107, until it is ejected by the tapered light guide plate 101 at an oblique angle relative to the rearward surface 106. For example, light ray 115 shown in FIG. 1C is redirected from the reflector 113 as ray 117 towards the cylindrical surface 105 of the light guide plate 101. On entry, example ray 117 is shown as propagating ray 118, which is reflected off the forward surface 107 of the light guide plate 101 as ray 119 and redirected back towards the rearward surface 106. Light that strikes the surface rearward surface 106 at less than the critical angle passes through rearward surface 106 towards light-turning film 103 and is turned out of the light guide plate 101 as shown in ray 121. A relatively low index of refraction layer can be placed between the light guide plate 101 and the light-turning film 103 to allow light to exit the light guide plate 101, as illustrated with the thin cladding layer between light guide plate 101 and light-turning film 103 in FIG. 1C. Remaining light continues to propagate within the light guide plate 101 by total internal reflection as rays 123 and 125. As illustrated in FIGS. 1A-1C, the light-turning film 103 is arranged over the rearward surface 106 of the light guide plate 101. However, in other implementations the light-turning film 103 can be arranged over the forward surface 107 of the light guide plate 101.

Figure 1D:
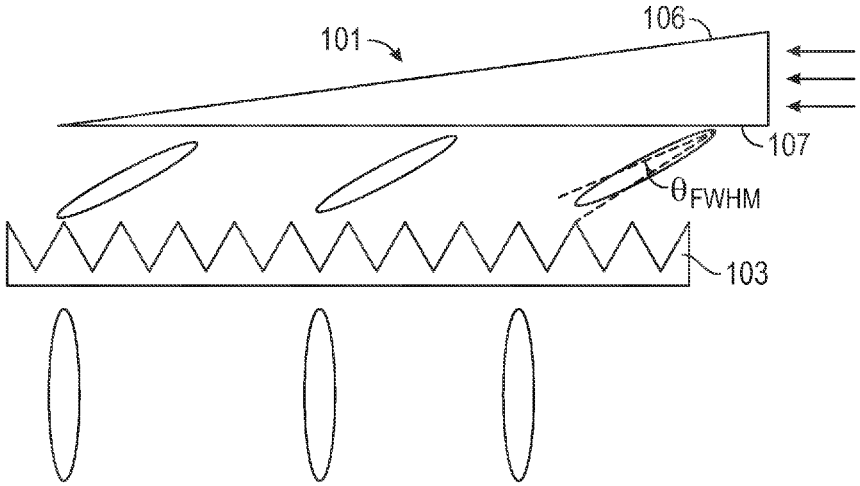
FIG. 1D illustrates an exploded schematic view of another implementation of a circular light guide plate with a light-turning film.

FIG. 1D illustrates an exploded schematic view of a cross section of one another implementation of a circular light guide plate with a light-turning film. As illustrated, the light-turning film 103 is arranged over the forward surface 107 of the light guide plate 101. In this configuration, light enters the light guide 101 from the right side and propagates through the light guide plate 101 as described above. In some implementations, the rearward surface 106 can be metalized so as to prohibit light from being emitted through the rearward surface 106. Light propagates within light guide plate 101 until emitted from forward surface 107 at an oblique angle relative to the forward surface 107. In some implementations where narrower beams are preferred, the light beam emitted from the forward surface 107 has a beam width, for example, $\theta_{FWHM}$=60 degrees or less, 45 degrees or less, 30 degrees or less, 15 degrees or less, 10 degrees or less, or 5 degrees or less. In other implementations where wider beams are preferred, the light beam emitted from the forward surface 107 has a beam width, for example, $\theta_{FWHM}$=120 degrees or less or 90 degrees or less. Light emitted from forward surface 107 can interact with light-turning film 103. As illustrated, the light-turning film 103 turns the light such that it exits the light-turning film 103 substantially perpendicular to the light guide plate 101 and the forward surface 107 of the light guide plate 101. The light-turning film 103, in the illustrated implementation, does not substantially affect the angular beam width of the light, for example, the light-turning film 103 does not affect the full width at half maximum of the beam, $\theta_{FWHM}$. Rather, the light-turning film 103 redirects incident light from the circular light guide plate 103. The prism-like features of the light-turning film 103 need not be symmetric, and are shown as symmetric for illustrative purposes only. Although illustrated as turning light to be perpendicular to the forward surface 107, in other implementations the light-turning film 103 can be configured to turn the light at any angle relative to the forward surface 107. Moreover, the light-turning film 103 need not be uniform. For example, one portion may turn light at a first angle, with a second portion turning light at a second angle.

Figure 1E:
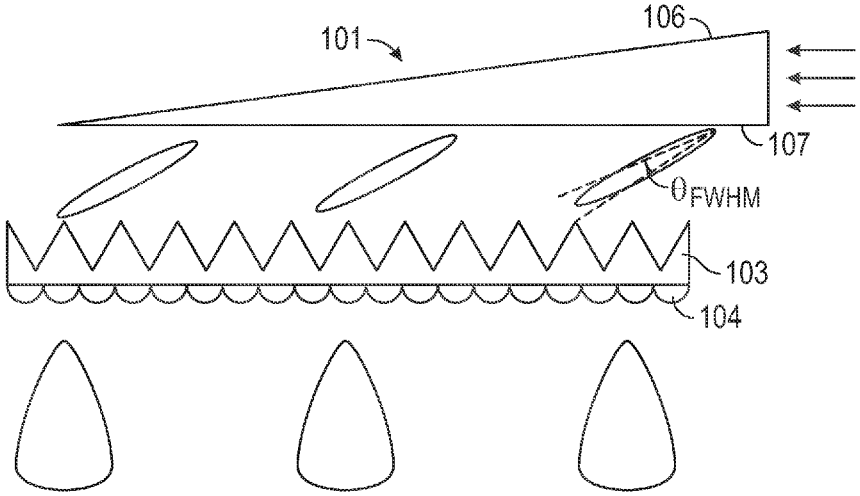
FIG. 1E illustrates an exploded schematic view of another implementation of a circular light guide plate with a light-turning film and a lenticular film.

FIG. 1E illustrates an exploded schematic view of a cross section of another implementation of a circular light guide plate with a light-turning film and a lenticular film. Similar to the implementation of FIG. 1D, the light-turning film 103 is arranged over the forward surface 107 of the light guide plate 101. Light emitted from forward surface 107 interacts with light-turning film 103. In the illustrated implementation, a lenticular film 104 is arranged over the forward surface of light-turning film 103. The lenticular film 104 operates to spread light along one meridian. As illustrated, the optical film stack shown, including light-turning film 103 and lenticular film 104, turns the light such that it exits the light-turning film 103 substantially perpendicular to the light guide plate 101 and the forward surface 107 of the light guide plate 101, with a substantially increased width. As noted above, although illustrated as turning light to be perpendicular to the forward surface 107, in other implementations the light-turning film 103 can be configured to turn the light at any angle relative to the forward surface 107. Moreover, the light-turning film 103 and the lenticular film 104 need not be uniform. In various embodiments, one or more films (for example, light-turning films, lenticular films, etc.) can be stacked on top of one another to create the desired output beam.

Figure 1F:
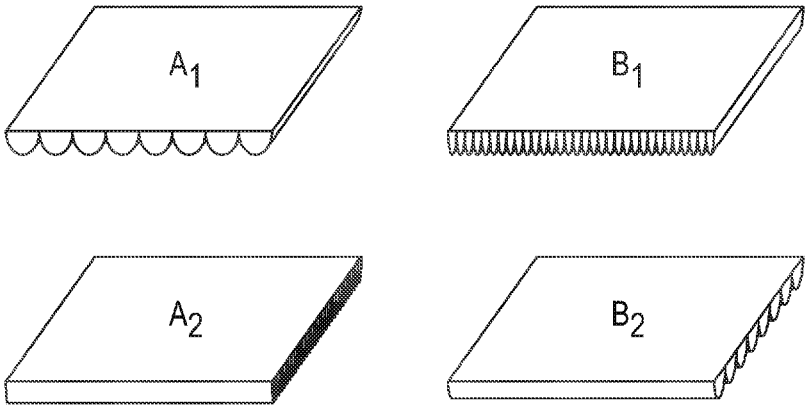
FIGS. 1F and 1G illustrate enlarged perspective views of one implementation of a stack of optical films.
Figure 1G:
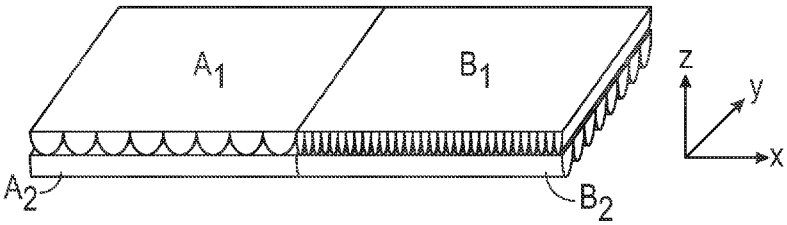

FIGS. 1F and 1G illustrate enlarged perspective views of one implementation of a stack of optical films. As illustrated, four separate films are shown: A1, A2, B1, and B2. As shown in FIGS. 1G, A1 and A2 are stacked on top of one another. Similarly, B1 and B2 are stacked on top of one another. Both A1 and A2 are lenticular-like films, with A1 configured to operate in the meridian plane such that light is spread along the x-z plane, and A2 configured to operate in the meridian plane such that light is spread along the y-z plane. A1 and A2 may both include, for example, semi-cylindrical (elongated lenses with semi-circular cross section) or elongated lenses with parabolic cross section or other aspheric cross section. However, as illustrated, the optical power of the lenticules in A1 differs from the optical power of the lenticules in B1. Additionally, the optical power of the lenticules in A1 differs from the optical power of those in A2, and similarly the optical power of the lenticules in B1 differs from the optical power of those in B2. As illustrated, the lenticules in A1 and B2 are semi-cylindrical, whereas the lenticules in A2 and B1 are parabolic in cross section. In various implementations, as the curvature of lenticules increases, the spreading effect increases. Accordingly, the lenticular-like film B1 spreads light further in the x-z plane than the lenticular-like film A1. Both A2 and B2 are also lenticular-like films. However, as illustrated, they are oriented so as to spread light in the y-z plane, perpendicular to that of the lencticular-like films A1 and B1. The curvature of the lenticules differs between A2 and B2, such that A2 operates to spread light further in the y-z plane than the lenticules in B2.

Figure 1H:
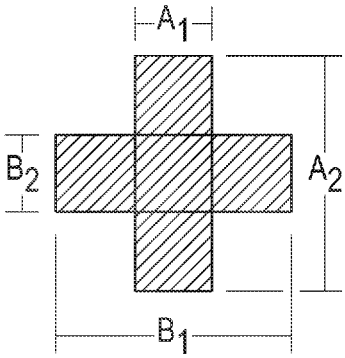
FIG. 1H illustrates a far-field pattern provided by the stacked optical films shown in FIGS. 1F and 1G.

FIG. 1H illustrates a far-field pattern provided by the stacked optical films shown in FIGS. 1F and 1G. The result is a cross-like pattern, whose dimensions are determined by the light-spreading function of the different lenticular-like films A1, A2, B1, and B2. Together, the lenticular-like films A1 and A2 form the vertical bar of the cross. The lenticules in A1 spread light laterally, and therefore A1 determines the width of the vertical bar of the cross. The lenticules in A2 spread light orthogonal to that, such that A2 determines the height of the vertical bar of the cross. A similar effect is achieved by the stack of lenticular-like films B1 and B2, which together create the horizontal bar of the cross. The laterally spreading lenticules of B1 determine the width of the horizontal bar of the cross, while the vertically spreading lenticules of B2 determine the height of the horizontal bar of the cross. Accordingly, each of the relative dimensions can be controlled independently of the others by varying the curvature, shape, and/or orientation of the lenticular-like films A1, A2, B1, or B2.

As shown in FIGS. 1A-1E, the light guide plate 101 is tapered such that its thickness decreases radially from the central portion to the peripheral portions. The tapering of the light guide plate 101 further assists light to be turned towards light-turning film 103, and output from the surface 106 or 107 of the light guide plate 101. In some implementations, one of surface 106 or 107 is reflective so that light only exits the light guide plate through the other of surface 107 or 106. For example, surface 106 may be reflective. In some implementations, the light guide plate 101 can be sloped from its central portion to its peripheral portions at an angle of about 5 degrees or less, 4 degrees, or 3 degrees or less. In some implementations, the light guide plate 101 can be sloped at an angle between 1 to 10 degrees. In some implementations, the angle can range from 2 to 7 degrees. In some implementations, the light-turning film can affect angular width of light distribution. The configuration of the light-turning film can assist in controlling the direction and distribution of light output from the light guide plate 101.

In some implementations, light emitted from LED emitter 109 can be evenly distributed across the surface of the light guide plate 101. In some implementations, light exiting the light guide plate 101 is substantially collimated. Additionally, "brightness" of the LED source is decreased because the light is distributed across a larger area.

In some implementations, the reflector 113 can be replaced by other functionally similar coupling optics, including segmented reflectors, a lens, groups of lenses, a light pipe section, one or more holograms, etc. As shown, the LED emitter (s) emit light in response to a DC operating voltage applied to terminals 127. In some implementations, the LED emitter assembly 109 may have a different form of light-emitting surface, such as a raised phosphor, raised clear encapsulent, etc.

Figure 2:
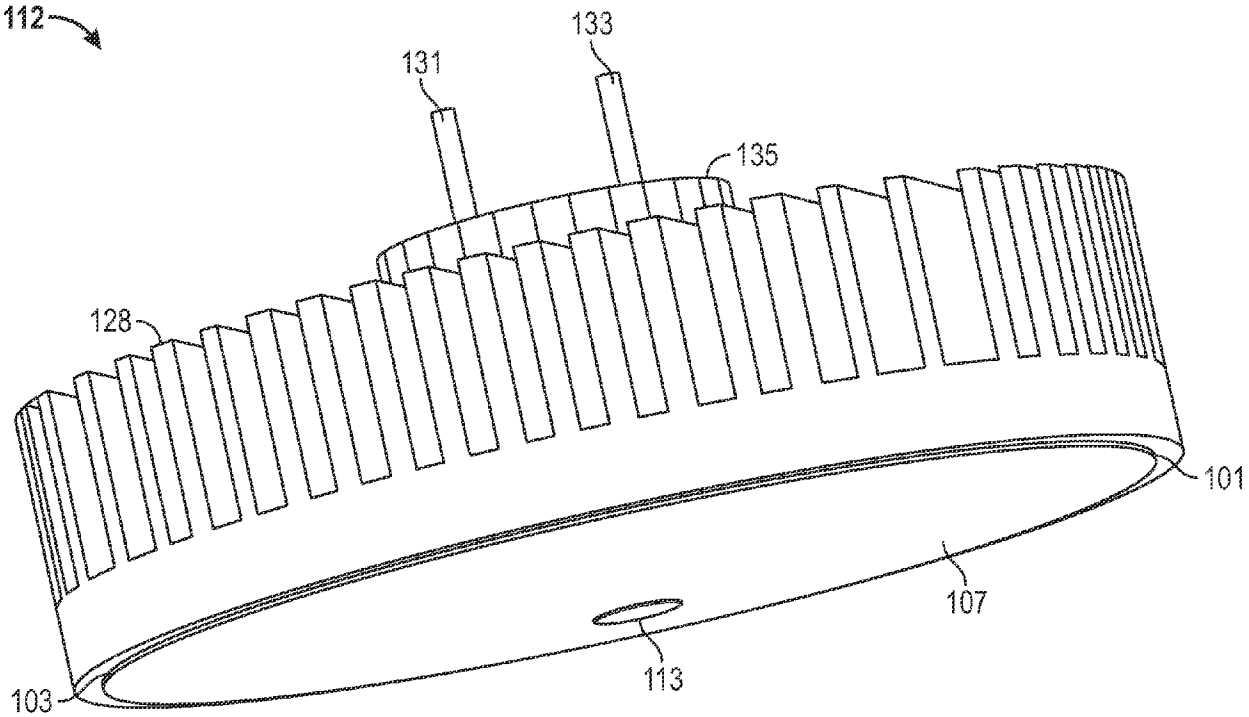
FIG. 2 illustrates another perspective view of an implementation of a light engine.

FIG. 2 illustrates another perspective view of an implementation of an individual light engine. As with the implementation illustrated in FIGS. 1B and 1C, the light engine 112 includes a reflector 113 and a light-turning film 103. As described above, light propagating through the light guide plate 101 is emitted from the surface 107 of the light guide plate 101. In the illustrated implementation, the light engine 112 further includes a heat sink 128. As shown, the heat sink includes a plurality of metal elements such as fins that extend away from the light guide plate 101 and radiate heat. In some implementations, one or more heat sinks can be attached to a support structure in thermal communication with the light engine 112, where the support structure is configured to receive more than one light engine 112 to form an array of light engines 112. As will be understood by one of skill in the art, various other configurations for heat-extracting elements are possible, and the illustrated implementation is just one example. The heat sink 128 reduces the danger that the light engine 112 will malfunction or otherwise be damaged due to excess heat generated by the LED emitter. The light engine 112 also includes electrical connecting pins 131 and 133, and an electrical conduit 135 for providing electrical interconnections to and from the interior terminals 127 of the LED emitter (not shown). This light engine may be associated with one or more LEDs. For example, an LED assembly may include an array or plurality of LEDs that emits light that is reflected by the reflector 113, guided in the light guide plate 101, and exits the front face 107 of the light engine 112.

Figure 3A:
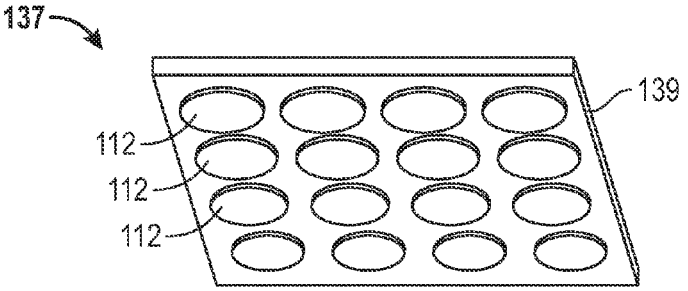
FIG. 3A illustrates a perspective view of an implementation of an array of light engines mounted in a support structure.

FIG. 3A illustrates a perspective view of an implementation of an array of light engines mounted in a support structure. As illustrated, a large-area optical structure can be formed by an array 137 of light engines 112, mounted onto a support structure 139. In some implementations, the support structure 139 can include an integrated heat sink or other heat extraction element. Depending on the size and number of individual light engines 112, an array 137 of various sizes can be achieved. For example, in certain implementations, the array 137 can have a diagonal length of approximately 20 inches. In other implementations, the diagonal length of the array 137 can be approximately 16 inches. In some implementations, the dimensions of the array 137 can range from between 8 square inches to about 72 square inches. Depending upon the density of light engines 112 within the array 137, as well as the particular configurations of the light engines 112, the array 137 can be configured to achieve a lumen density between about 0.025 and about 0.25 lumens per square millimeter.

Figure 3B:
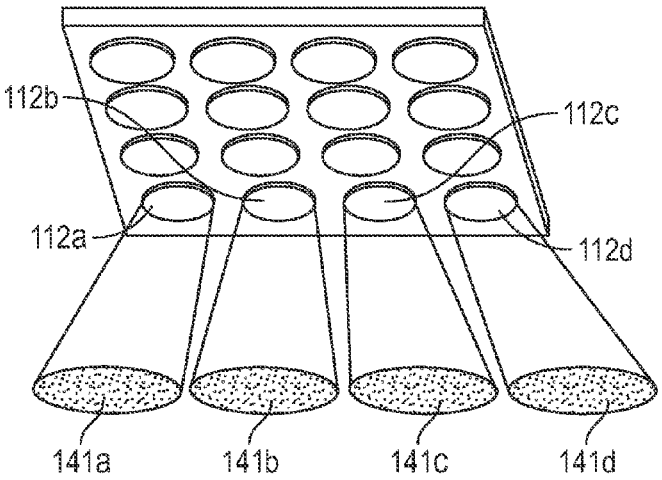
FIGS. 3B and 3C illustrate perspective views of an implementation of an array of light engines with example output beams.
Figure 3C:
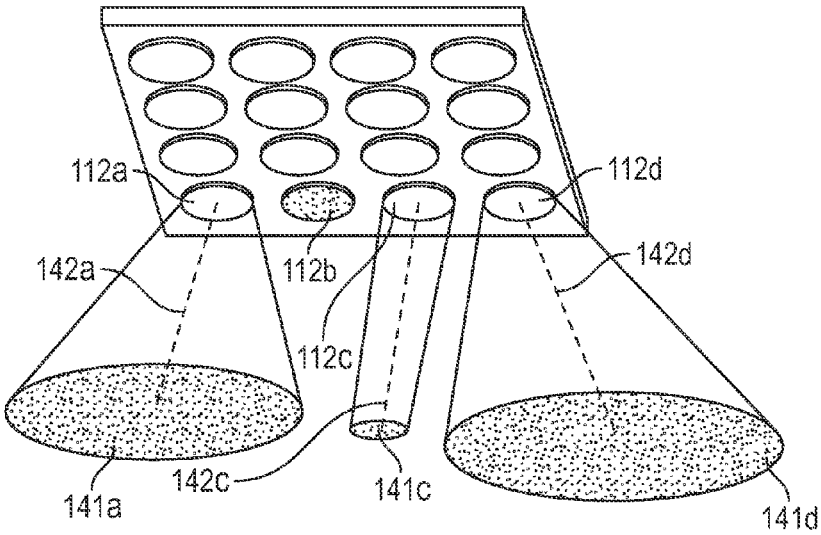

FIGS. 3B and 3C illustrate perspective views of an implementation of an array of light engines with example output beams. For clarity, output beams are only shown from four exemplary light engines: first light engine 112*a*, second light engine 112*b*, third light engine 112*c*, and fourth light engine 112*d*. In use, all or fewer of the individual light engines 112 may be illuminated, depending on the particular application. As shown in FIG. 3B, the four output beams 141*a*-141*d* are essentially the same size. In such a configuration, the array 137 can provide uniform lighting over a given area. In some implementations, the four output beams 141*a*-141*d* all illuminate the same general location on a floor or a wall, so that the circles illustrated in FIG. 3B overlap completely or partially. In other implementations, at least one of the output beams 141*a*-141*d* can differ from another output beam in one of beam width (full width at half maximum) or beam direction (direction of the beam at maximum intensity). For example, each light engine may be provided with a separate light-turning film 103 (not shown), so that light is simultaneously directed to different locations from different light engines. Control of the direction of light improves efficiency and can be used to reduce unwanted glare outside of the area of interest. The power supplied to the light emitter in each light engine can also be separately, electronically controlled. For example, one light engine directed at one area can be switched on, while another light engine directed at another area is switched off. One light engine can be dimmed with respect to another light engine. Different light intensity from different light engine permits the output illumination to be customized to accommodate the application, conditions, or preference. For example, lights directing beams to a desk can be set to a higher intensity than lights that direct light to other background locations. In addition, in some implementations the light engines themselves may face different directions due to physical hinges or other mechanisms for turning and/or moving the light engines relative to one another. Such physical control of the light engines can be combined with the optical films to achieve the desired output beams.

In addition, accessory optical films may be used in conjunction with the light engine to create various shapes and patterns. The optical films may be designed to be removable or permanently affixed to the light engines. In some implementations, the light beams emanating from the light engines may be transformed into beams having different far-field shapes, for example, square or rectangular, elliptical, etc. The optical film beams may cause the beams to have different aspect ratios. One implementation of an optical film may provide, for example, wider divergence or distribution of light in the x direction than in the y direction to create, for example, an elliptical or rectangular far-field shape. The optical film can also provide for tilting of the beam, varying amount of divergence, increased collimation, and/or spot lighting. One implementation provides a narrow beam directed to one area and a wide beam direct to another area. Another implementation of an optical film may create patterns in the far field forming various graphics or images. Some implementations of an optical film can operate on different wavelengths and thus cause different colored optical beams to have different properties. For example, the optical film may include a dichroic filter or other type of filter. In some implementations the optical film may includes a color absorber such as a dye to form the color filter. Different filters of different color can be used for different light engines to produce different effects. For example, a red beam can be redirected in one direction and a blue beam can be redirected into another direction. The shapes of the red beam and the blue beam can also be altered to be different using the optical films. Color images and graphics may therefore be formed in the far field.

Many variations are possible to provide for a variety of lighting applications with one illumination system. For example, an engine that outputs a beam at a wide divergence angle may be switched off while an engine that outputs a beam with a fairly collimated beam or a beam with a narrower angle engine is switched on or kept on (or vice versa). Similarly, both light engines may be kept on but one may be electrically driven to produce a brighter output than the other.

As illustrated in FIG. 3C, the output beams 141*a-d* can vary widely from one another. Beam direction is indicated by the direction of the center line through each beam. For example, the center line 142*a* through output beam 141*a* corresponds to the beam direction of the output beam 141*a*. As shown, output beams 141*a* and 141*d* differ in orientation while the divergence angle of the beam is the same. The output beam 141*d* however is directed further away from the normal to the array than output beam 141*a*, as indicated by the divergence of center line 142*a* and center line 142*d* away from the normal. Output beam 141*c* has a substantially narrower beam width, resulting in a spot-light effect. This beam 141*c* is slightly converging. The second light engine 112*b* is illustrated in an off position, and therefore produces no output beam. As will be understood, these exemplary output beams serve to illustrate some possible variations that may be achieved with an array 137 of light engines 112. Numerous other variations can similarly be achieved. These varying optical effects can be achieved either through the use of a separate optical film applied forward the surface a light engine 112, or alternatively the light engine 112 may itself be configured to produce the desired effect. For example, the beam direction can be influenced using a light-turning film, for example light-turning film 103. Similarly, the angular divergence of the beam and the far-field shape of the beam can be influenced using a lenticular lens or sheet or stack of lenticular lenses or sheets. For example, to shape the beam in two meridians (along an x axis and a y axis), a stack of two lenticular lenses or sheets may be used where one lenticular lens acts upon the light in one meridian and a second lenticular lens acts upon the light in another meridian. Also, although each of the first, third, and fourth light engine 112*a*, 112*c*, and 112*d* are shown as producing a different type of beam, in certain implementations a first set of light engines are configured to produce similar beams and a second set of light engines are configured to produce similar light beams however the light beams produced by each set are configured to be different. For example, the second and third light engines 112*b*, 112*c* may be configured to produce red beams 141*b*, 141*c* that are collimated and directed normal to the array while the first and fourth light engines 112*a*, 112*d* may be configured to produce light beams 141*a*, 141*d* that are divergent and directed at a non-normal angle with respect to the array.

Figure 3D:
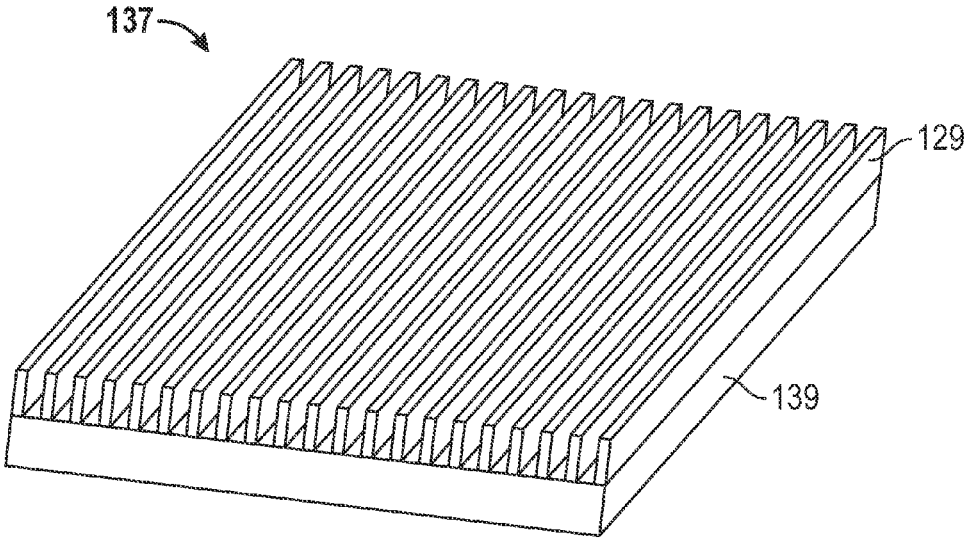
FIG. 3D illustrates a rear perspective view of the support structure shown in FIGS. 3A-3C.

FIG. 3D illustrates a rear perspective view of the support structure shown in FIGS. 3A-3C. A heat sink 129 is arranged over the rear surface of the support structure 139. As shown, the heat sink includes a plurality of metal elements such as fins that extend away from the support structure 139 and radiate heat. As will be understood by one of skill in the art, various other configurations for heat-extracting elements are possible, and the illustrated implementation is just one example. The heat sink 129 reduces the danger that the individual light engines 112 or the entire array 137 will malfunction or otherwise be damaged due to excess heat generated by the LED emitter assemblies. The heat sink 129 can comprise metal, such as aluminum or other substantially heat conducting material. In some implementations, the heat sink 129 allows for the attachment of light engines 112 without individual heat sinks where the heat sink functionality is integrated into the support structure. For example, in some implementations, the light engine that engages the support structure does not include an individual heat sink 128 as illustrated in FIG. 2. In such implementations, the thermal management of the LED in the light engine may be instead performed by the heat sink 129 integrated into the support structure, as illustrated in FIG. 3D. In other implementations, an individual heat sink 128 as shown FIG. 2 can, once the light engine is engaged in the support structure, be in thermal communication with the heat sink 129 of the support structure illustrated in FIG. 3D.

Figure 4A:
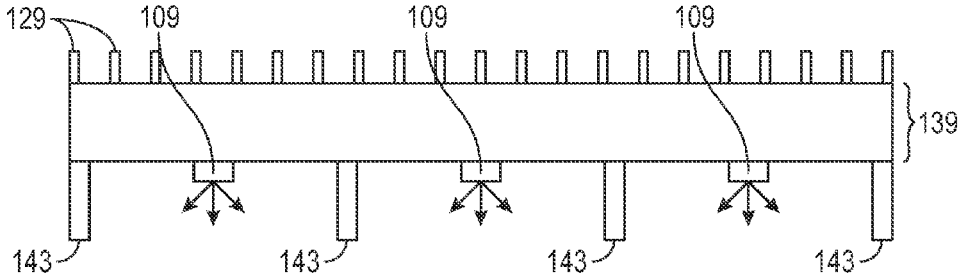
FIG. 4A illustrates a schematic view of a support structure with a plurality of LED emitters.

The Figures herein, including but not limited to FIGS. 4A-6C, are illustrated schematically, and the elements may not be drawn in correct proportion. For example, the LEDs are shown greatly enlarged for ease of explanation. In some implementations, individual LEDs can be miniscule relative to a light guide plate. FIG. 4A illustrates a schematic view of a support structure 139 with a plurality of LED emitter assemblies 109 each including at least one LED emitter. The support structure 139 can include an heat sink 129 arranged over the rear surface. As shown, the heat sink 129 includes a plurality of metal fins extending away from the support structure 139. As noted previously, various other configurations for the heat sink 129 are possible. A plurality of LED emitters assemblies 109 are coupled to the support structure 139. The LED emitter assemblies 109 can be arranged in an array or other desired configuration. Light emitted from LED emitters extends in all directions. Surrounding each LED emitter assembly 109 are pairs of connecting members 143. As illustrated, a single connecting member 143 separates adjacent LED emitter assemblies 109. However, in other implementations, each connecting member 143 is adjacent only to a single LED emitter assembly 109. Additionally, in some implementations only a single connecting member 143 is associated with a particular LED emitter assembly 109. In other implementations, three or more connecting members 143 can be associated with a particular LED emitter assembly 109.

Figure 4B:
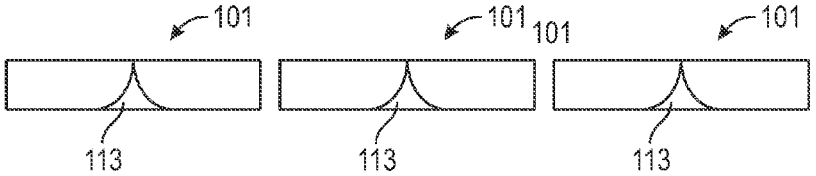
FIG. 4B illustrates a schematic view of a plurality of light guide plates coupled to reflectors.

FIG. 4B illustrates a schematic view of a plurality of light guides coupled to reflectors. Each light guide 100 includes a light guide plate 101, as discussed above. The light guide plate 101 can take several different forms. For example, in some implementations the light guide plate 101 is tapered, as illustrated in FIGS. 1A-1D. In some implementations, a separate light-extracting film can be disposed over the surface of the light guide plate 101. Additionally, one or more beam-shaping films can be coupled with the light guide plate 101. As illustrated, a reflector 113 is coupled to each light guide 101. The reflector 113 may be integrated within the light guide plate 101, or as described above in FIGS. 1B and 1C, the light guide plate 101 may include an aperture in which the reflector 113 is positioned. The light guide plates 101 are each configured to be removably coupled to the support structure 139 via connecting members 143. Various mechanisms for removably coupling the light guide plates 101 to the support structure 139 can be employed. For example, in some implementations the light guide plates 101 can each include a snap-fit mechanism that engages with connecting members 143 for a secure connection. The snap-fit connection can be readily reversed, allowing for removal of light guide plates 101 from the support structure 139. In some implementations, connecting members 143 can include a clasp, strap, or similar that holds the light guide plate 101 in place against the support structure 139. In other implementations, the light guide plates 101 can be screwed into the support structure 139. Various other engagement mechanisms are possible. Accordingly, the connecting members can be configured and located differently than as shown in FIG. 4A.

Figure 4C:
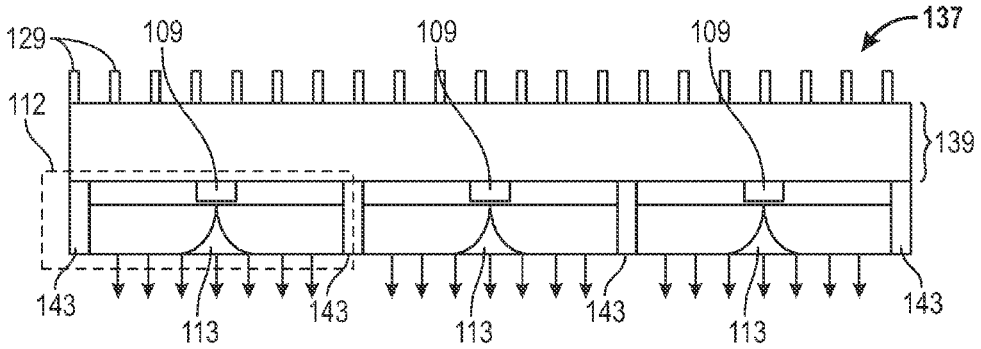
FIG. 4C illustrates a schematic view of the light guides of FIG. 4B mounted onto the support structure of FIG. 4A.

FIG. 4C illustrates a schematic view of the light guides of FIG. 4B mounted onto the support structure of FIG. 4A. The combined structure forms an array 137 of light engines 112. As illustrated, light emitted from LED emitters is redirected from reflectors 113 to propagate within the light guide plates 101. The light is guided in light guide plates 101 and is eventually extracted from the light guide plate 101. The extracted light is illustrated as having uniform directionality across the three illustrated light guide plates 101. However, as discussed above, each light engine 112 can be tailored to produce different output beams. For example, a film may vary between light engines 112 to alter the beam direction, beam width, color, polarization, or other characteristic of the output beam. Additionally, in some implementations a separate optical film may be disposed forward or rearward the film. The separate optical film may similarly be configured to alter the characteristics of the output beam as desired.

Figure 5A:
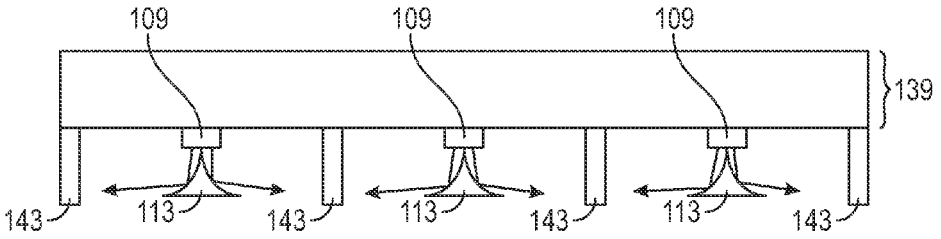
FIG. 5A illustrates a schematic view of a support structure with a plurality of LED emitter assemblies coupled to reflectors.

FIG. 5A illustrates a schematic view of a support structure with a plurality of LED emitter assemblies coupled to reflectors. The support structure 139 can include an integrated heat sink within it. A plurality of LED emitter assemblies 109 are coupled to the support structure 109. As with FIG. 4A, surrounding each LED emitter assembly 109 are pairs of connecting members 143. In the implementation illustrated in FIG. 4A, however, light from LED emitter assemblies 109 is directed in a Lambertian fashion. Instead, in the implementation in FIG. 5A, a reflector 113 is arranged over each LED emitter assembly 109 to provide directionality to the emitted light. Light emitted from each LED emitter assembly 109 is redirected by reflector 113 to propagate radially from the reflector 113.

Figure 5B:
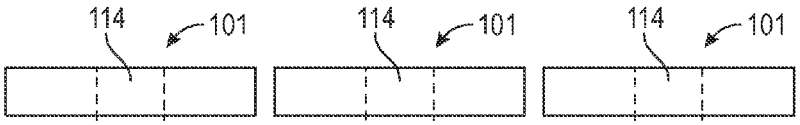
FIG. 5B illustrates a schematic view of a plurality of light guide plates.

FIG. 5B illustrates a schematic view of a plurality of light guides. Unlike the implementation described with respect to FIG. 4B, the light guide plates 101 do not also include a reflector. Rather, the reflector 113 is coupled to the LED emitter assembly 109, and maintains its position even when the light guide plate 101 is removed from the support structure 139. Each light guide plate 101 can include an open region in which the reflector 113 is positioned. The light guide plates 101 are each configured to be removably coupled to the support structure 139 via connecting members 143. As noted above, various mechanisms for removably coupling the light guide plates 101 to the support structure 139 can be employed.

Figure 5C:
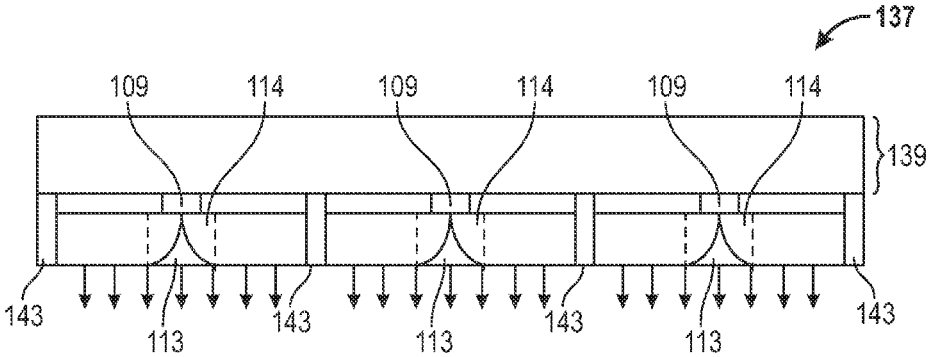
FIG. 5C illustrates a schematic view of the light guides of FIG. 5B mounted onto the support structure of FIG. 5A.

FIG. 5C illustrates a schematic view of the light guide plates of FIG. 5B mounted onto the support structure of FIG. 5A. The combined structure forms an array 137, and functions as described with respect to FIG. 4C. Light emitted from LED emitter assemblies 109 is redirected from reflectors 113 to propagate within the light guide plates 100. In some implementations, the area around reflector 113 can be filled with a dielectric plug to fit into the cylindrical hole 114 in the center of the light guide plate 101. Optical coupling between the reflector 113 and the light guide plate 101 can be improved by the use of optical adhesives between the two. In some implementations in which a dielectric plug is omitted, light exits the LED 109 into air, reflects off the surface of reflector 113 in the air, and then enters the light guide plate 101 through a cylindrical input surface defined by the hole 114 in its center. In an implementation where the light guide plate 101 has parallel opposing sides, the light propagates within the light guide plate 101 until extracted by faceted features on the light guide plate 101 or by a separate light-extracting film. In other implementations, the light guide plate 101 may be tapered, as described above with respect to FIGS. 1A-1C and 2. The extracted light is illustrated as having uniform directionality across the three illustrated light guide plates 101. However, as discussed above, each light engine 112 can be tailored to produce different output beams. For example, light-turning and/or optical films, as discussed elsewhere, may vary between light engines 112 to alter the beam direction, beam width, color, polarization, or other characteristic of the output beam.

Figure 6A:
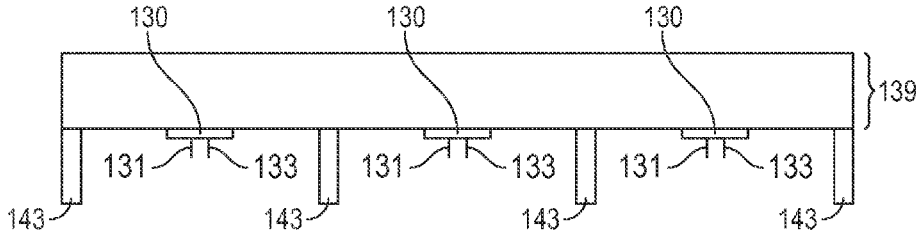
FIG. 6A illustrates a schematic view of a support structure.

FIG. 6A illustrates a schematic view of a support structure. The support structure 139 is illustrated including a plurality of thermal coupling surfaces 130, which are configured to thermally contact the LED emitter assemblies 109. As described above, the support structure 139 can include an integrated heat sink within it, although an integrated heat is not illustrated in order to emphasize other aspects of the illustrated implementation. It is also understood that, in some implementations, there may not be an integrate heat sink. The illustrated thermal coupling surfaces 130 can provide for thermal communication between the LED emitter assemblies 109 and the integrated heat sink within the support structure 139. Each of the thermal coupling surfaces 130 is illustrated as having two electrical connecting pins 131 and 133 for providing electrical interconnections to and from the LED emitter assemblies 109. In other implementations, the electrical connecting pins 131 and 133 can be integrated with the LED emitter assembly 109, and can be configured to be removably inserted into receiving slots in the support structure 139. In other implementations, other configurations for electrical connection can be employed. Unlike the implementations in FIGS. 4A and 5A, the LED emitter assemblies 109 are not integrated with the support structure 139, but are rather integrated with the light guide plate 101. The LED, reflector, and waveguide as a single integrated unit may be removably attached to the support structure, for example via receptacle or connecting members 143 and pins 131 and 133.

Figure 6B:
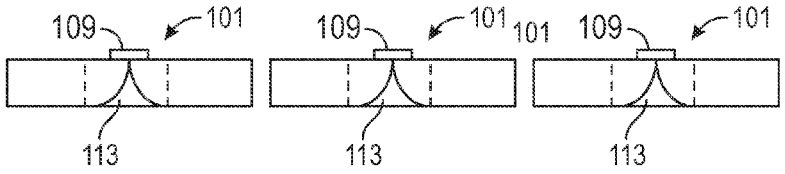
FIG. 6B illustrates a schematic view of a plurality of light guide plates coupled to reflectors and LED emitter assemblies.

FIG. 6B illustrates a schematic view of a plurality of light guide plates coupled to reflectors and LED emitter assemblies. Unlike the implementation described with respect to FIGS. 4B and 5B, the light guide plates 101 include attached thereto an LED emitter assembly 109, in addition to a reflector 113. Each light guide plate 101 can include an open region in which the reflector 113 is positioned, with the LED emitter assembly 109 aligned with the reflector 113 as discussed above. The light guide plates 101 are each configured to be removably coupled to the support structure 139 via connecting members 143. As noted above, various configurations for removably coupling the light guide plates 101 to the support structure 139 can be employed. Along with the mechanical connection of the light guide plates 101, the LED emitter assemblies 109 are electrically connected to conductive paths supported by the support structure through electrical connecting pins 131 and 133, through heat sinks 129. In other implementations, other configurations for electrical connection can be used.

Figure 6C:
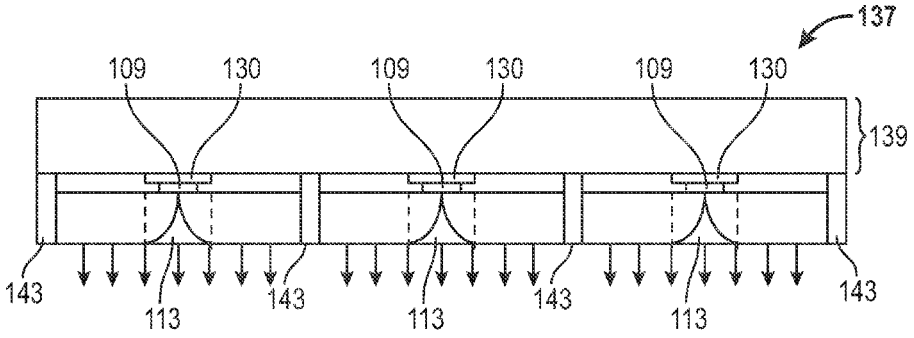
FIG. 6C illustrates a schematic view of the light guides of FIG. 6B mounted onto the support structure of FIG. 6A.

FIG. 6C illustrates a schematic view of the light guides of FIG. 6B mounted onto the support structure of FIG. 6A. The combined structure forms an array 137, and functions as described with respect to FIGS. 4C and 5C. Light emitted from LED emitter assemblies 109 is redirected from reflectors 113 to propagate within the light guide plates 100. In an implementation where the light guide plate 101 has parallel opposing sides, the light propagates within the light guide plate 101 until extracted by a light-extracting features or a film. In other implementations, the light guide plate 101 may be tapered, as described above with respect to FIGS. 1A-1C and 2. The extracted light is illustrated as having uniform directionality across the three illustrated light guide plates 101. However, as discussed above, each light engine 112 can be tailored to produce different output beams. For example, light-turning and/or optical films, as discussed elsewhere, may vary between light engines 112 to alter the beam direction, beam width, color, polarization, or other characteristic of the output beam.

Figure 7A:
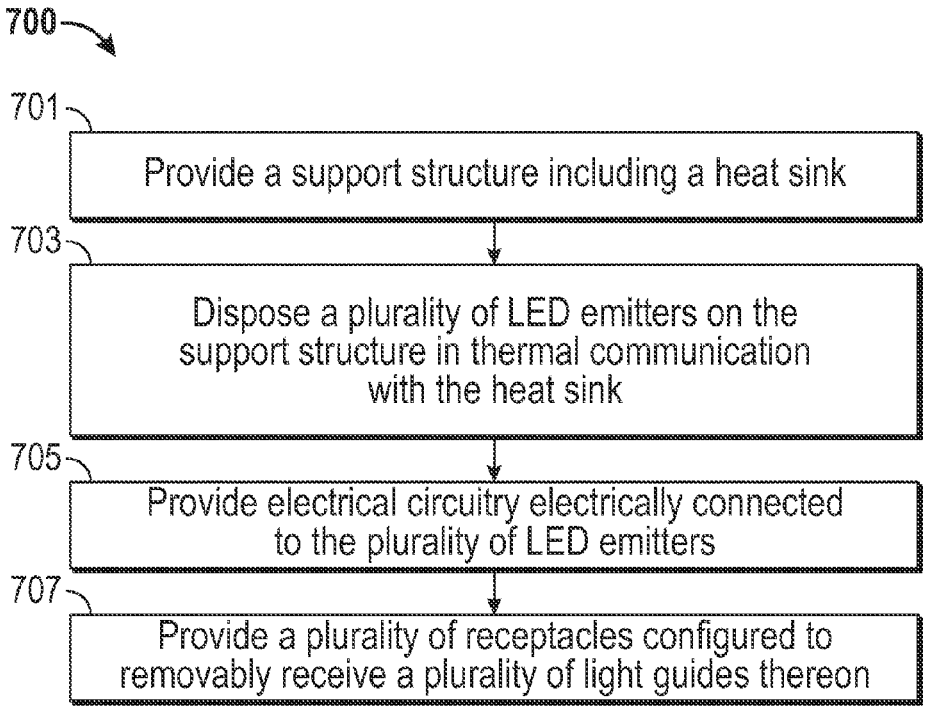
FIG. 7A shows a flow diagram of a method of manufacturing an illumination system, according to one implementation.

FIG. 7A shows a flow diagram of a method of manufacturing an illumination system, according to one implementation. The process 700 begins with block 701, providing a support structure that includes a heat sink. In block 703, a plurality of LED emitters are disposed on the support structure in thermal communication with the heat sink. As noted previously, thermal communication between the LED emitters and the heat sink can reduce the risk of damage to the light guides or LED emitters due to overheating during operation. In block 705, electrical circuitry is provided that is electrically connected to the plurality of LED emitters. The electrical circuitry can provide both power and control over the LED emitters. In block 707, a plurality of receptacles are included in the plurality of LED emitters. The plurality of receptacles can each be configured to removably receive a light guide thereon. Light guides can thereby be easily attached to and detached from the support structure, allowing a single support structure to produce a wide range of illumination effects, depending on the applied light guides, as well as the electronic control of the LED emitters.

Figure 7B:
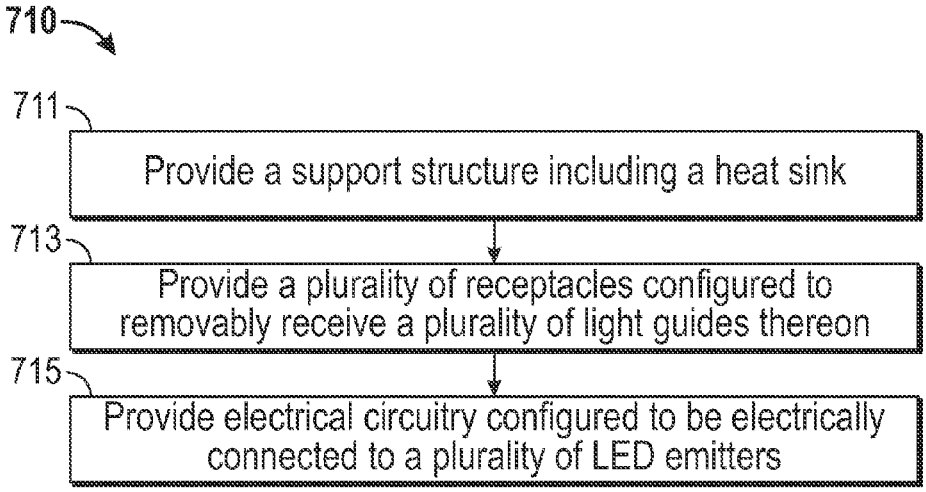
FIG. 7B shows a flow diagram of a method of manufacturing an illumination system, according to another implementation.

FIG. 7B shows a flow diagram of a method of manufacturing an illumination system, according to another implementation. The process 710 begins with block 711, providing a support structure that includes a heat sink. In block 713, a plurality of receptacles is provided. The receptacles are configured to removably receive a plurality of light guides thereon. In block 715, a plurality of electrical sockets and/or electrical connectors along with electrical circuitry is provided that is configured to be electrically connected to a plurality of LED emitters. As noted previously, in some implementations the heat sink can provide for thermal conduction between LED emitters removably coupled with the receptacles and the heat sink, thereby reducing the risk of damage to the light guides or LED emitters due to overheating during operation. The electrical circuitry can provide both power and control over LED emitters, once coupled with the electrical sockets and/or connectors. In some implementations, the plurality of receptacles are not provided for the light guides. In such implementations, the mechanical engagement afforded by the electrical sockets and/or electrical connectors provides enough support for a light engine including both an LED emitter and a light guide such that the further mechanical support of the receptacle may be optional.

Thus, an array of light engines can be provided that forms a light fixture having a large aperture such that light is evenly distributed over the large aperture. In some implementations, each light engine is directionally controllable so that beams from the light engines may be directed towards various directions. In some implementations, different light guides can be removably coupled to a support structure, allowing for interchangeability of light guides. In some implementations, accessory optical films are used in conjunction with the light engines that can alter the light to provide illumination having different far field shapes and distributions. The combination of these features provides for an improved illumination system for high ceiling applications that can be thin, light, efficient, safe for viewing having reduced glare compared to an LED alone without a light guide, and that enables custom control in the distribution of light.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein. The word "exemplary" is used exclusively herein to mean "serving as an example, instance, or illustration." Any implementation described herein as "exemplary" is not necessarily to be construed as preferred or advantageous over other implementations. Additionally, a person having ordinary skill in the art will readily appreciate, the terms "upper" and "lower" are sometimes used for ease of describing the figures, and indicate relative positions corresponding to the orientation of the figure on a properly oriented page, and may not reflect the proper orientation of the system as implemented.

Certain features that are described in this specification in the context of separate implementations also can be implemented in combination in a single implementation. Conversely, various features that are described in the context of a single implementation also can be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example processes in the form of a flow diagram. However, other operations that are not depicted can be incorporated in the example processes that are schematically illustrated. For example, one or more additional operations can be performed before, after, simultaneously, or between any of the illustrated operations. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products. Additionally, other implementations are within the scope of the following claims. In some cases, the actions recited in the claims can be performed in a different order and still achieve desirable results.

What is claimed is:

1. An illumination system comprising:

a support structure including:

a heat sink;

a plurality of light emitting diode (LED) emitters;

electrical circuitry electrically connected to the plurality of LED emitters; and a plurality of receptacles configured to removably receive a plurality of light guides thereon;

a reflector disposed forward at least one of the LED emitters, the reflector configured to redirect incident light from the LED emitter radially outwardly; and at least one light guide removably coupled to one of the receptacles, the light guide configured to receive the radially outwardly directed light from the reflector.

2. The illumination system of claim 1, wherein the plurality of LED emitters includes at least 8 LED emitter assemblies each comprising at least one LED emitter.

3. The illumination system of claim 1, further including control electronics connected to the electrical circuitry capable of independently controlling optical power of at least a first LED emitter and a second LED emitter.

4. The illumination system of claim 3, wherein the control electronics is configurable to cause the optical power output by the first LED emitter and the optical power output by the second LED emitter to be substantially different.

5. The illumination system of claim 1, wherein the receptacles are configured to receive one light guide corresponding to each of the plurality of LED emitters.

6. The illumination system of claim 1, wherein the receptacles include a clasp or a strap to hold the at least one light guide thereon.

7. The illumination system of claim 1, wherein the reflector is radially symmetrical.

8. The illumination system of claim 1, further comprising an optical film coupled to the at least one light guide, the optical film having an optical characteristic.

9. The illumination system of claim 8, wherein the plurality of light guides include a first light guide and a second light guide, the first light guide paired with a first optical film, the second light guide paired with a second optical film, and wherein the first optical film is configured to produce a first output beam and the second optical film is configured to produce a second output beam, wherein the first output beam and the second output beam differ in at least one optical characteristic.

10. The illumination system of claim 9, wherein the optical characteristic includes one of beam shape, far-field pattern, color, beam direction, and/or width.

11. The illumination system of claim 10, wherein the far-field pattern includes one or more of a square, rectangle, circle, ellipse, or combinations thereof.

12. The illumination system of claim 1, wherein the light guide includes a plate, wherein a first portion of the light guide is at a center of the plate, wherein a second portion of the light guide is at the periphery of the plate, and wherein the light guide decreases in thickness radially from the first portion to the second portion.

13. The illumination system of claim 12, wherein the light guide is sloped from its first portion to its second portion at an angle of 5 degrees or less.

14. An illumination system comprising:

a support structure, including:

a plurality of light emitting diode (LED) emitters;

means for extracting heat from the plurality of LED emitters;

electrical connection means electrically connected to the plurality of LED emitters; and means for removably receiving a plurality of light guides thereon;

means for reflecting incident light from at least one of the LED emitters such that the redirected light is directly radially outwardly; and at least one light guide removably coupled to the means for removably receiving, the light guide configured to receive the radially outwardly directed light from the means for reflecting incident light.

15. The illumination system of claim 14, wherein heat extracting means includes a heat sink or wherein the receiving means includes a receptacle, or wherein the means for reflecting incident light includes a reflector.

16. A method of manufacturing an illumination system, the method comprising:

providing a support structure including a heat sink;

disposing a plurality of light emitting diode (LED) emitters on the support structure in thermal communication with the heat sink;

providing electrical circuitry electrically connected to the plurality of LED emitters;

including a plurality of receptacles with the plurality of light emitting diode emitters, the plurality of receptacles configured to removably receive a plurality of light guides thereon, disposing a reflector forward at least one of the LED emitters, the reflector configured to redirect incident light from the LED emitter radially outwardly; and removably coupling at least one light guide to one of the receptacles, the light guide configured to receive the radially outwardly directed light from the reflector.

17. The method of claim 16, wherein disposing the plurality of LED emitters includes disposing at least 8 LED emitter assemblies each comprising at least one LED emitter.

18. The method of claim 16, further comprising providing control electronics electrically connected to the electrical circuitry, wherein the plurality of LED emitters are independently controllable by the control electronics.

19. The method of claim 16, wherein the receptacles are configured to receive one light guide corresponding to each of the plurality of LED emitters.

20. A method of manufacturing an illumination system, the method comprising:

providing a support structure including a heat sink;

providing a plurality of receptacles configured to removably receive one or more light guides thereon providing electrical circuitry configured to be electrically connected to a plurality of LED emitters;

providing a reflector configured to be disposed forward at least one of the LED emitters, the reflector configured to redirect incident light from the LED emitter radially outwardly; and providing at least one light guide configured to be removably coupled to one of the plurality of receptacles, the light guide configured to receive the radially outwardly directed light from the reflector.

21. The method of claim 20, further comprising electrically connecting control electronics to the electrical circuitry, wherein the control electronics are configured to control the plurality of LED emitters independently.

22. The illumination system of claim 1, wherein the receptacles and the at least one light guide are engaged using a snap-fit connection.

* * * * *